US007722803B2

(12) United States Patent
Nigarura et al.

(10) Patent No.: US 7,722,803 B2
(45) Date of Patent: May 25, 2010

(54) HIGH CARBON SURFACE DENSIFIED SINTERED STEEL PRODUCTS AND METHOD OF PRODUCTION THEREFOR

(75) Inventors: Salvator Nigarura, Centerville, OH (US); Rick Ellingsworth, Englewood, OH (US); Eric Riley, Troy, OH (US); Juan R. L. Trasorras, Ann Arbor, MI (US)

(73) Assignee: PMG Indiana Corp., Columbus, IN (US)

( * ) Notice: Subject to any disclaimer, the term of this patent is extended or adjusted under 35 U.S.C. 154(b) by 242 days.

(21) Appl. No.: 11/493,991

(22) Filed: Jul. 27, 2006

(65) Prior Publication Data

US 2008/0025863 A1 Jan. 31, 2008

(51) Int. Cl.
*C22C 33/02* (2006.01)

(52) U.S. Cl. ..... 419/11

(58) Field of Classification Search ..... 419/11
See application file for complete search history.

(56) References Cited

U.S. PATENT DOCUMENTS

| | | | |
|---|---|---|---|
| 2,333,573 | A | 11/1943 | Kalischer |
| 2,489,838 | A | 11/1949 | Webb |
| 2,489,839 | A | 11/1949 | Whitney |
| 2,757,446 | A | 8/1956 | Boegehold et al. |
| 2,827,407 | A | 3/1958 | Carlson et al. |
| 3,150,444 | A | 9/1964 | Reen |
| 3,416,976 | A | 12/1968 | Brill-Edwards |
| 3,658,604 | A | 4/1972 | Hale |
| 3,698,877 | A | 10/1972 | Motoyoshi |
| 3,810,756 | A | 5/1974 | Koehler |
| 3,889,350 | A | 6/1975 | Mocarski |
| 3,992,763 | A | 11/1976 | Haynie et al. |
| 4,002,471 | A | 1/1977 | Sarnes et al. |
| 4,230,506 | A | 10/1980 | Clark |
| 4,243,414 | A | 1/1981 | Takahashi et al. |

(Continued)

FOREIGN PATENT DOCUMENTS

| | | | |
|---|---|---|---|
| GB | 2187757 | A | 9/1987 |

(Continued)

OTHER PUBLICATIONS

Chatterley, T.C., "Cam and Cam-Follower Reliability," SAE Paper 885033, 1998.

(Continued)

*Primary Examiner*—Roy King
*Assistant Examiner*—Jie Yang
(74) *Attorney, Agent, or Firm*—Metz Lewis LLC; Barry I. Friedman

(57) ABSTRACT

A powder mixture alloy is provided for manufacturing surface densified high carbon sintered steel articles containing iron or iron pre-alloyed powder, which has been preliminary mixed with at least 0.4 wt % graphite, lubricant and optionally at least one alloying element from the group of nickel, chromium, copper, manganese and molybdenum. Components are manufactured utilizing the alloy mixture comprising the steps of: a) compacting the metallic powder to obtain a compact; b) pre-sintering the compact at a low temperature to prevent graphite from diffusing into the iron; c) surface densifying of the pre-sintered compact to a predetermined densification depth; d) sintering under neutral gas or carburizing atmosphere; e) heat treating the sintered compact.

24 Claims, 7 Drawing Sheets

U.S. PATENT DOCUMENTS

| | | | | |
|---|---|---|---|---|
| 4,783,898 | A | 11/1988 | Kanamaru et al. | |
| 4,829,950 | A | 5/1989 | Kanamaru et al. | |
| 4,870,931 | A | 10/1989 | Nakamura et al. | |
| 4,969,262 | A | 11/1990 | Hiraoka et al. | |
| 5,476,632 | A | 12/1995 | Shivanath et al. | |
| 5,540,883 | A | 7/1996 | Jones et al. | |
| 5,613,180 | A | 3/1997 | Kosco | |
| 5,659,873 | A | 8/1997 | Seyrkammer | |
| 6,123,748 | A | 9/2000 | Whitaker et al. | |
| 6,338,747 | B1 | 1/2002 | Kosco | |
| 6,473,964 | B1 * | 11/2002 | Anderson et al. | 29/888.1 |
| 6,632,263 | B1 | 10/2003 | Nigarura et al. | |
| 2001/0012490 | A1 | 8/2001 | Yamauchi | |
| 2003/0029272 | A1 | 2/2003 | Vidarsson et al. | |

FOREIGN PATENT DOCUMENTS

| | | | |
|---|---|---|---|
| GB | 2298869 | A | 9/1996 |
| JP | 57-108246 | | 7/1982 |
| JP | 61044152 | A | 3/1986 |

OTHER PUBLICATIONS

Nakamura, Yoshikatsu; Egami, Yasuyoshi; "Development of an Assembled Camshaft by Mechanical Bonding," SAE Paper 96032, 1996.

Trasorras, Juan R.L.; Nigarura, Salvator; and Sigl, Lorenz S.; "DensiForm Technology for Wrought-Steel-Like Performance of Powder Metal Components," SAE Paper 2006-01-0398, 2006.

Wykes, F.C., "Summary Report on the Performance of a Number of Cam and Cam Follower Material Combinations Tested in the MIRA Cam and Follower Machine," MIRA Research Report No. 1970/3.

* cited by examiner

HIGH CARBON SURFACE DENSIFIED SINTERED STEEL PRODUCTS AND METHOD OF PRODUCTION THEREFOR

FIELD OF THE INVENTION

This invention relates generally to sintered iron-based powder metal alloy articles. The invention further relates to sintered powder metal alloy articles having significant carbon content uniformly distributed therein. Additionally, the invention further relates to the manufacturing of surface densified components with uniform high hardness directly from the sintering operation without the need for carbon enrichment.

BACKGROUND OF THE INVENTION

Ferrous-based sintered materials have typically not been a material of choice for utilization in high strength applications because of their intrinsic porosity. However, sintered products have high versatility as to shape and are easily manipulated into complex forms for relatively low cost. In general, sintered products exhibit low strength when formed from low carbon materials, and they have low formability when containing a significant amount of carbon.

In the case of low carbon materials, surface densification is a technology that greatly improves mechanical properties and strength, in particular contact and bending fatigue properties. This technology has been proven efficient for manufacturing moderately loaded automotive powertrain components such as gears, sprockets and races using low or carbon free materials. Several methods have been proposed to surface densify these articles. Among them, several have been successfully implemented in high volume manufacturing, being those that perform the surface densification as some form of a cold forming process. Cold forming, as compared to hot forming, has four key advantages: (1) results in high precision components; (2) has low tooling wear; (3) avoids oxidation of the work piece; and (4) does not require heating of the work piece. However, cold forming has important limitations as well. It is well known in metal forming technology that cold forming is severely limited by: (1) high yield strength of the material that results in extremely high forming stress that, in turn, can induce tooling failure and requires larger forming equipment; and (2) low material workability, in that the material ability to withstand plastic strain, without failure, e.g., fracture, under a given stress state is reduced. These deleterious effects are exacerbated by the presence of carbon in the powder mixture in any significant amount. While higher carbon concentrations add strength to the component parts, these higher carbon components are only effective if little or no post sintering workability is required.

The presence of carbon, furthermore, does not facilitate an increase in density of the sintered forms. In most applications, full densification of the surface layer is required for reasonable performance, which is generally incompatible with alloys containing a significant amount of carbon.

The workability or formability of the material is further limited by the presence of porosity, which greatly reduces the strain required to cause fracture. For example, sintered steel with more than 0.3 wt % carbon and 5% or more porosity is limited to 0.5-2% deformation before rupture. For an effective densification, a component with a density of 7.2 g/cm$^3$ will need over 9% deformation to reach a full density of 7.87 g/cm$^3$. The required level of deformation will be higher if the initial density of the part is lower.

As stated above, surface densification methods have primarily relied on the use of materials with either no or very low carbon content, typically under 0.2 wt %. Iron (no carbon) or low carbon steels exhibit workability that is higher than that of higher carbon steel. However, the use of low carbon steel has some important practical limitations. Low carbon steels are not directly heat treatable; they require addition of carbon prior to heat treatment, typically through a gas carburization process. Carburizing processes are lengthy and expensive, particularly for large components. Such heat treatment produces a hard surface layer of few millimeters (0.1 to 2 mm) deep and a relatively carbon free soft core. In some applications where the stresses are confined to the shallow surface layer, the current technology has produced very good results. Indeed, careful selection of alloying elements and optimization of post-sintering operations such as the carburization process have been successfully applied in manufacturing of high performance surface densified low carbon powder metal products. As reported in SAE Paper # 0396, 2006 by Trasorras, Nigarura and Sigl and in Gear Solutions pages 18-22, July 2006 by Ulf Engstrom, surface densification of low carbon powder metal components produces equivalent or higher performance when compared with low carbon wrought or forged steels.

These successful developments in powder metal technology, however, fail to provide the performance required in applications where through-hardened forged components are necessary, such as those disclosed in U.S. Pat. Nos. 3,992,763 and 4,002,471.

An alternative method to produce surface densified high carbon materials which are competitive with through-hardened forged components is therefore lacking in the art. Such a method would need to be capable of producing a surface densified product which can be hardened directly in a sintering furnace if given an accelerated cooling; hardened by induction directly after sintering or through-hardened by a short austenitization period followed by oil quenching.

SUMMARY OF THE INVENTION

A method is disclosed which provides a manufacturing process and a product that is flexible with respect to the selection of a final hardening process, based upon the use of significant carbon content. Hardening directly in a sintering furnace, or sinterhardening; induction hardening right after sintering or post sintering austenitization and oil quenching are particularly favored applications. This process increases the ability to cold form powder metal components to compete directly with similar components manufactured by hot forging and wrought steel technology.

The present invention provides an efficient method to process high carbon sintered steels and to locally densify them at the surface to densities of or above 7.7 g/cm$^3$ for all components with a core density between 6.8 g/cm$^3$ and 7.4 g/cm$^3$. The composition of the final products produced by this method utilizes an initial metallic powder mixture containing iron or iron pre-alloyed powder, which has been preliminarily mixed with at least 0.3 wt % graphite and preferably 0.4 to 0.9 wt % graphite, approximately 0-1% wax lubricant and at least one or a combination of alloying elements selected from the group consisting of: nickel, chromium, copper, manganese and molybdenum. The content of each of the selected alloying elements in this group is generally between 0 and 3 wt % each and preferably 2 wt %. The total weight percent of alloying elements is generally in the range of 0-5 wt %. The Mo is preferably prealloyed into the base iron powder_and the other alloying elements are either added as elemental powders or prealloyed in the base powder.

The method of manufacturing articles or components from the disclosed alloy comprises the steps of compacting a metallic powder containing iron or iron pre-alloyed powder, which has been preliminarily mixed with at least 0.3% graphite and preferably 0.4 to 0.9 wt % graphite, lubricant and optionally at least one alloying element from the group of nickel, chromium, copper, manganese and molybdenum to obtain a compact; pre-sintering the powder metal article at low temperatures to prevent graphite from diffusing into the iron;.surface densifying the article at critical areas to achieve at least 97% of iron theoretical density in those areas; sintering the article to put carbon in solution and complete the sintering process, and optionally heat treating the article.

The method enables the cost-effective manufacture of high carbon surface densified sintered articles. In the pre-sintered state, high carbon preforms exhibit good workability and can be readily surface densified. Because of the high carbon content, once sintered, these articles have high hardenability and can be directly heat treated following sintering by a variety of methods, e.g., fast cooling in the sintering furnace, gas quenching in the sintering furnace, post sintering induction hardening, through hardening (austenitizing and quenching), and the like.

Further features and advantages of the present invention will be apparent upon consideration of the following detailed description of the present invention, taken in conjunction with the following drawings.

BRIEF DESCRIPTION OF THE DRAWINGS

These and other features and advantages of the present invention will become more readily appreciated when considered in connection with the following detailed description and appended drawings, wherein.

DESCRIPTION OF THE PREFERRED EMBODIMENTS

Figure 1:
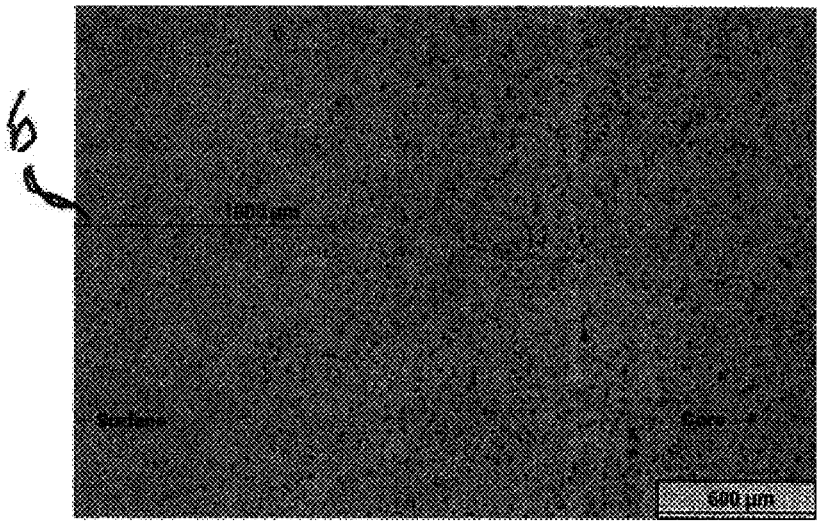
FIG. 1 is a photomicrograph of the unetched microstructure of the surface densified portion of the high carbon material.

The alloy and associated method of manufacturing may be applied to any powder metal component where high strength is desirable and, more particularly, where surface features and shapes are amenable to near-net shape sintered materials. Applications include automotive drive and valve train components, such as transmission gears. These transmission gears require very high contact and bending fatigue strength.

The powder metal alloy blend may be formed of the following composition: 97.40 wt % (Fe—Mo) pre-alloyed powder, 2.0 wt % nickel powder, 0.6% graphite powder, and 0.6 wt % wax lubricant. In order to form components from the disclosed alloy composition, the mixture is cold compacted in a die at 40-65 psi to form a specimen with an approximate density of 7.2 g/cm$^3$. External lubricants such as zinc stearate or organic lubricants are typically applied to the die to foster proper mold release. The formed compact is then pre-sintered at 1950° F. for 0.5 to 1 hour in an atmosphere of at least 95% nitrogen, balance hydrogen. This pre-sintering step is particularly designed to promote bonding of the powder particles without fostering carbon diffusion beyond the iron grain boundaries of the component materials. This results in a preform which is more prone to withstand the stress of deformation during cold working.

The pre-sintered compact, or preform, is then densified at the working surface of the material by cold forming. This cold forming step may include extrusion, burnishing, rolling or any other method that induces plastic deformation of steel in cold state without the aid of heat other than typical heat generated by friction between two metals in contact under load.

The cold formed preform is then sintered at a temperature around 2100° F. for 25 minutes in a 95% $N_2$/5% $H_2$ atmosphere. The nitrogen-hydrogen atmosphere must be capable of chemically reducing any oxygen and/or impurity content found in the metal powders and the ratio will be primarily dependent upon the particular mixture of alloying elements being utilized. Alternatively, sintering can be carried out under vacuum with similar results. Precise control of the carbon content in the perform is critical and carbon loss by decarburization due to high water vapor content or high levels of oxygen in the furnace should be avoided. In particular situations, carbon can be added in the sintering furnace to increase the overall carbon concentration in the final part beyond the level of admixed graphite in the powder.

Depending on the alloying elements, the sintered components may be fast cooled in the sintering furnace at a cooling rate of at least 1.5° F./sec between 1000° F. and 400° F. to form a microstructure composed of at least 90% martensite in the entire section of the part. Alternatively, the components are hardened by: (1) induction heating the sintered component on critical surfaces for approximately 1-3 seconds and subsequently quenching in oil or water; or (2) austenitization by heating in a furnace under carburizing or neutral carbon atmosphere between 1600° F. and 1950° F. followed by quenching in oil or water. Heat treatment may be performed by sinterhardening, induction or austenitization and quenching, any of which may be followed by tempering in air between 300° F. and 450° F. for 1 to 2 hours.

The prior art materials typically utilized carburization at this point in the manufacturing process to achieve some degree of carbon penetration into the sintered part. Typical carburization parameters for low or carbon free materials include more than 4 hours of exposure to carbon containing gas at high temperatures to achieve high carbon concentration at the surface or near-surface region at a depth determined by the time and temperature that the part is exposed to this carbon atmosphere in furnace. Such carburized parts are characterized by a gradient of carbon concentration from the surface to a predetermined distance where the carbon is 0.4 wt % of the immediately surrounding matrix. The structure of this carbon-rich section corresponds to a martensitic structure which provides high strength only in the relatively shallow surface layer. This process is expensive and cumbersome, especially when utilized for large parts. In some cases, uneven exposure of the part to the carbon gas causes inconsistent penetration of the carbon inside the part resulting in limited or inconsistent structural strength and/or limited performance of the finished component. Beside cost, one significant disadvantage of extended time in the carburization furnace at high temperature is the increase in grain size of the finished part. Increased grain size is undesirable, resulting in lower strength and low fracture resistance.

The sintered components disclosed herein exhibit relatively small grain size, typical of powder metal components, while achieving an approximate carbon concentration of 0.5 wt %, which, moreover, is generally uniformly distributed throughout the component. The high carbon content throughout the part ensures the formation of a martensite structure in the entire section of the part which results in improved performance not only at the part surface, but more uniform strength and fracture resistance throughout the entire component. Additionally, the elimination of the carburization step results in significant cost and time savings in the manufacturing of the components.

Figure 2:
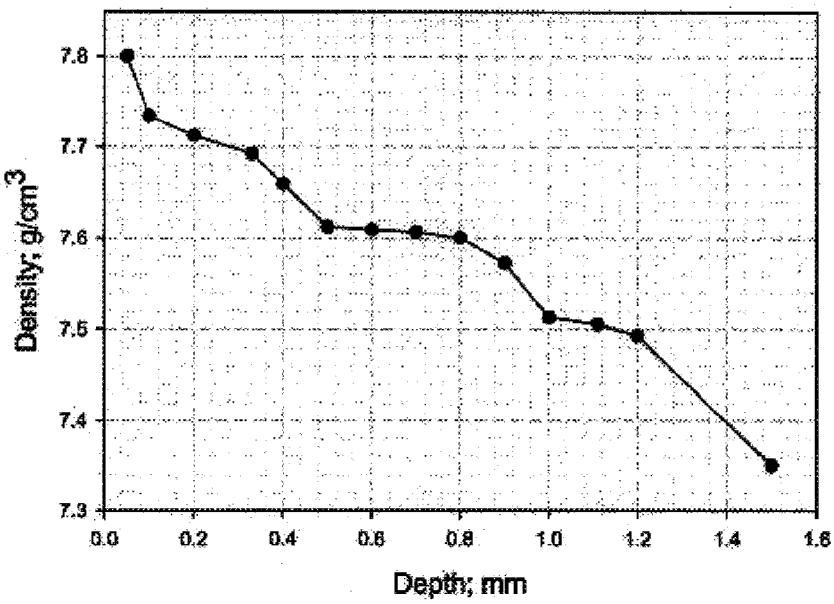
FIG. 2 is a diagrammatic representation of the surface density profile of the high carbon material.
Figures 3, 3A, 3B, 3C:
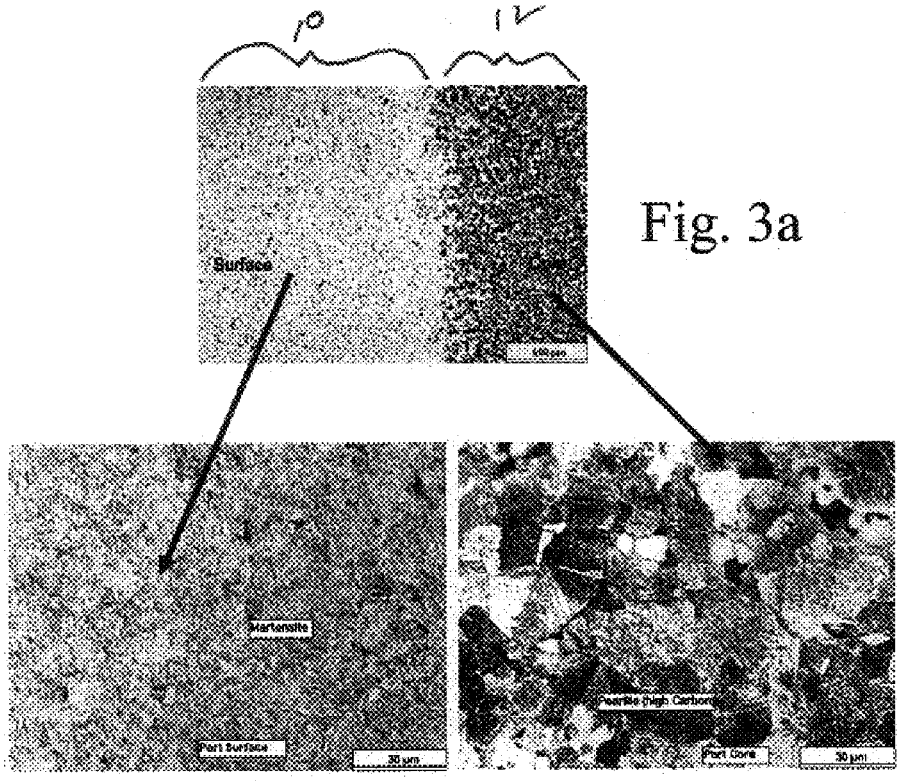
FIG. 3 is a series of photomicrographs of the heat-treated microstructure of the high carbon material as performed by induction hardening.
Figures 4, 4A, 4B, 4C:
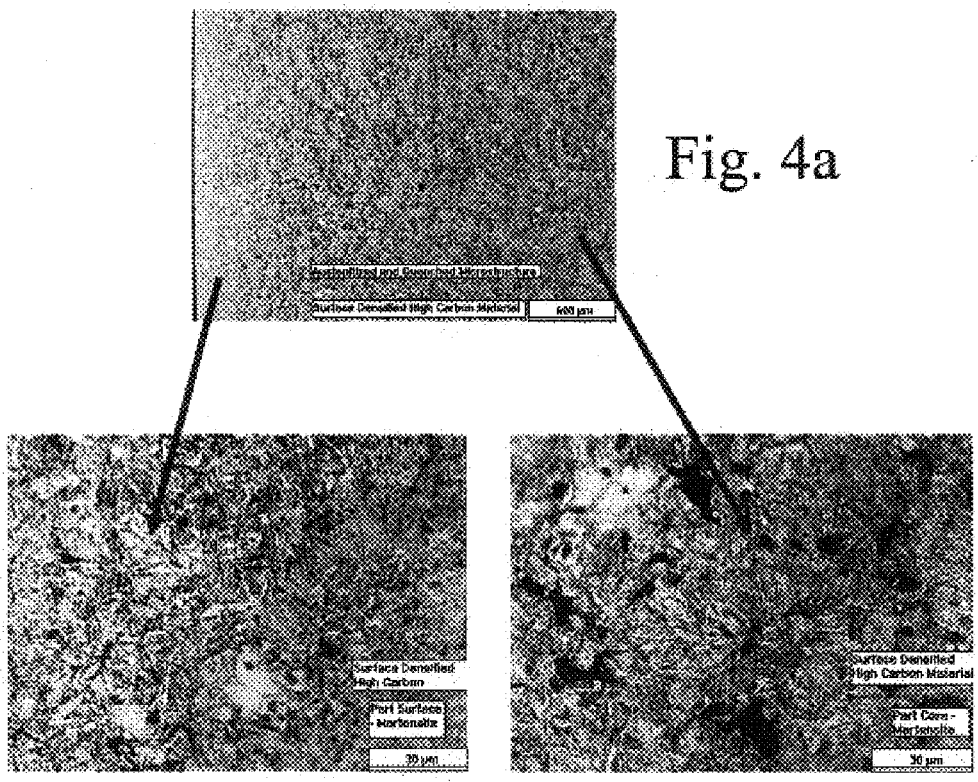
FIG. 4 is a series of photomicrographs of the heat-treated microstructure of the high carbon material as performed by quench and temper.
Figure 5:
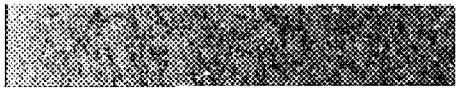
FIG. 5 is a photomicrograph of the heat-treated, carburized microstructure of the low carbon material of the prior art.
Figure 5:
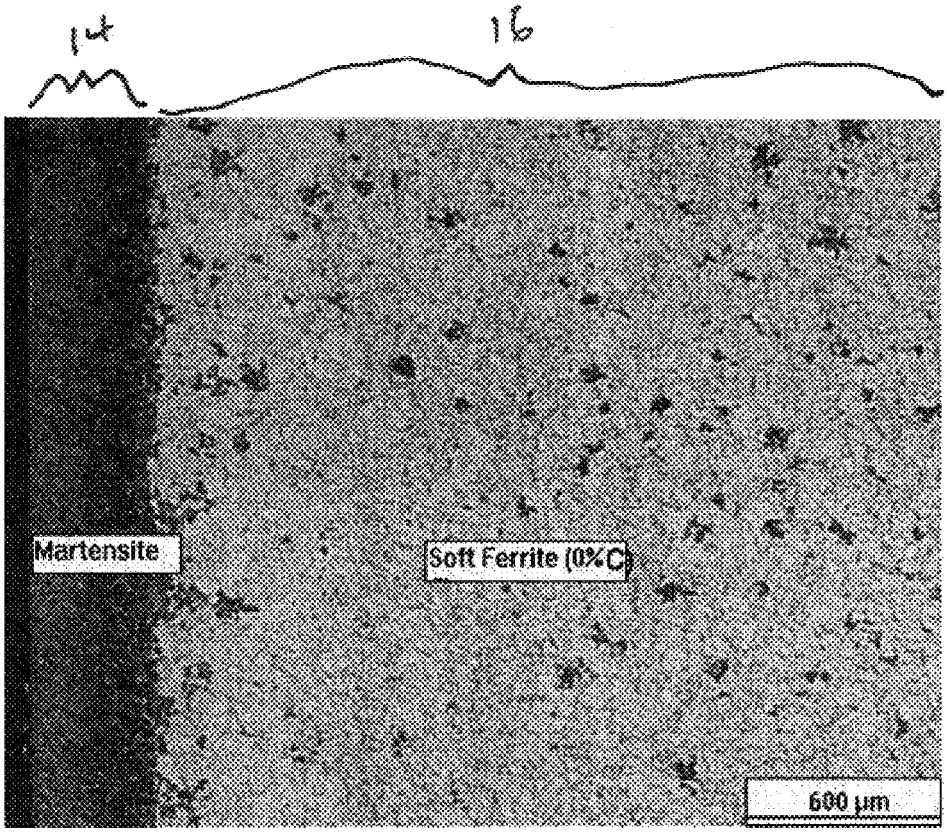
Figure 6:
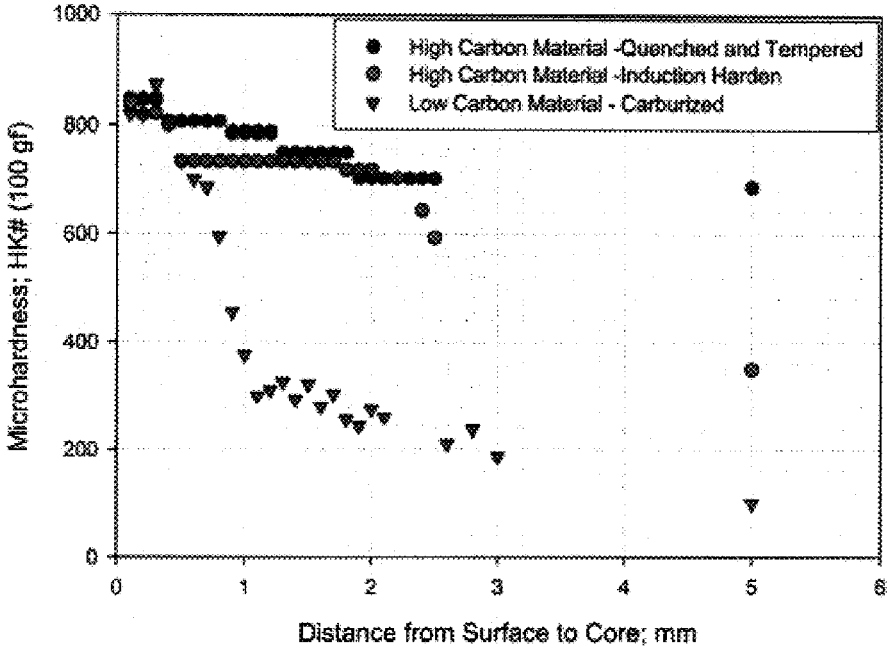
FIG. 6 is a diagrammatic representation comparing the microhardness profiles of the heat-treated high and low carbon materials.

Referring now to FIG. 1, a typical un-etched microstructure of the surface densified portion of the high carbon material is illustrated. The figure shows a gradient of fully to less densified material within the 1000 um region identified by arrow 5. The fully densified layer is approximately 100 um. The density of the material gradually decreases with depth from the surface to the core, as labeled, until it reaches the core density of 7.35 g/cm$^3$. The density is visually apparent by from the increasing population of black spots which represent the pore in the material. FIG. 2 illustrates a profile of density as a function of depth. Density was determined using an image analysis technique. The material has a density greater than 97% (7.6 g/cm$^3$) of steel theoretical density to a depth of approximately 0.8 mm. Typical microstructures of surface densified high carbon material are shown in FIGS. 3 and 4. For comparison, a microstructure of a surface densified carbon free material is shown in FIG. 5. The microhardness profiles comparing the surface densified high carbon material and the low carbon material of the prior art after heat treatment are shown in FIG. 6, which clearly illustrates the differences in hardness within the core at various depths.

The method as disclosed provides a significant amount of flexibility of the final internal microstructure, depending on the post-sintering heat treatment. As seen in FIGS. 3, 4 and 5 the internal microstructure can be entirely martensitic or only martensitic at a surface layer, depending on these parameters. In FIG. 3, the high carbon material achieves a martensitic deep hardened layer of at least 2.5 mm after directly hardening by induction heating and quenching. The depth layer may be selected by the particular parameters utilized during the heat treatment. As seen in FIG. 4, after austenitization and quenching, the surface densified high carbon material is through-hardened and forms martensite in all of the part section. As shown in FIG. 3*a*, the martensitic surface layer 10 of an induction hardened component is contrasted with the pearlite core section 12. Higher magnification in FIGS. 3*b* and 3*c* reveal the martensitic and pearlitic microstructures more clearly. FIG. 4 illustrates similar characteristics of a component which has been through-hardened by austenitization and quenching. As shown in FIG. 4*a*, a uniform martensitic microstructure is shown, while FIGS. 4*b* and 4*c* reveal with higher magnification that the component is completely transformed into martensite irrespective of the size or geometry of the component part.

Figure 7:
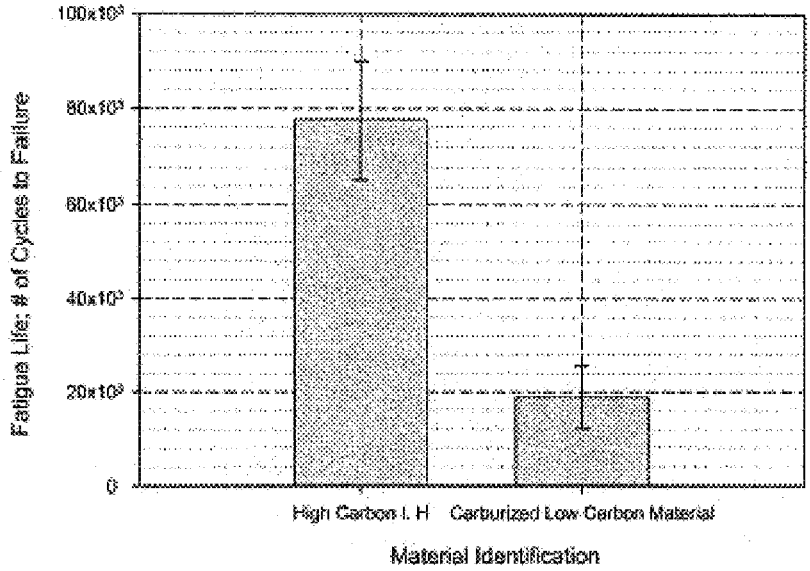
FIG. 7 is a diagrammatic representation comparing the fatigue life of the surface densified high and low carbon materials.

By comparison, the surface densified low carbon material forms a shallow layer of martensite 14 on surface and a soft ferrite structure 16 in most of the part section. The difference in microstructure as shown in this figure has a significant impact on performance especially in the applications requiring high fatigue strength. To characterize the fatigue strength difference between the surface densified materials with different base carbon contents, surface densified components made with the two types of materials were evaluated in a fatigue testing machine. The number of cycles to failure is plotted in FIG. 7 for the low and high carbon materials. The high carbon material produced according to the disclosed method increases the fatigue life by a factor of three, as compared to the carburized low carbon material. This is a substantial improvement in contact fatigue that illustrates the critical effect of the core hardness on fatigue life for heavily loaded components.

In addition to the improvement in strength, contact and bending fatigue, articles made from the sintered powder metal composition according to this invention display excellent dimensional stability and good machineability, properties that are critical from both a manufacturing and performance point of view.

Although particular embodiments of the present invention have been illustrated in the accompanying drawings and described in the foregoing detailed description, it is to be further understood that the present invention is not to be limited to just the embodiments disclosed, but that they are capable of numerous rearrangements, modifications and substitutions, as identified in the following claims.

What is claimed is:

1. A method of manufacturing high carbon surface densified sintered steel articles comprising the steps of:

a) compacting an iron-based powder containing at least 0.4 wt % C in the powder mixture to form an article such that the core density of said article is between 6.8 and 7.6 g/cc;

b) pre-sintering the article below 1950° C.;

c) subjecting the article to surface densification to increase the surface density to a value higher than the core density to a depth of 0.1-2.0 mm and form density gradient between the surface and the core; and d) sintering the article.

2. The method according to claim 1, further comprising a final step of heat treating the sintered article.

3. The method according to claim 1, wherein said iron-based powder comprises at least 0.5 wt % carbon.

4. The method according to claim 1, wherein the iron-based powder further comprises: 0.4 to 0.9 wt % graphite;

0.5 to 5 wt % of at least one alloying element selected from the group consisting of: nickel, chromium, copper, manganese and molybdenum;

0.3 to 0.75 wt % lubricant.

5. The method of claim 1, wherein the article is compacted to a core density between 6.8 g/cm$^3$ and 7.4 g/cm$^3$.

6. The method of claim 1, wherein the article is pre-sintered at a temperature ranging from 1400° F. to 1950° F.

7. The method of claim 6, wherein the diffusion of the graphite is reduced and retained at the iron grain boundaries.

8. The method of claim 1, wherein the article is sintered under neutral or carburizing atmosphere.

9. The method of claim 8, wherein the article is fast cooled inside the sintering furnace to form a hard martensite microstructure throughout the article section.

10. The method according to claim 1, wherein the article is induction hardened to a predetermined depth between 0.5 to 3 mm.

11. The method according to claim 8, wherein the article is austenitized between 1600° F. and 1900° F.

12. The method according to claim 11, wherein the article is oil or water quenched.

13. The method of claim 1, wherein at least a portion of the surface of the article is densified to at least 97% of iron theoretical density.

14. A sintered steel articles formed by the steps of:

a) compacting an iron-based powder containing at least 0.4 wt % C in the powder mixture to form the article such that the core density of said article is between 6.8 and 7.6 g/cc;

b) pre-sintering the article below 1950° C. such that the core density of said article is between 6.8 and 7.6 g/cc;

c) subjecting the article to surface densification to increase the surface density to a value higher than the core density to a depth of 0.1-2.0 mm and form density gradient between the surface and the core;

d) sintering the article.

15. The article of claim 14, further comprising a final step of heat treating the sintered article.

16. The article of claim 14, wherein said iron-based powder comprises at least 0.5 wt % carbon.

17. The article of claim 14, wherein said article comprises a densified surface having a hardness of 55-65 HRC.

18. The article of claim 14, wherein the iron-based powder further comprises:

0.4 to 0.9 wt % graphite;

0.5 to 5 wt % of at least one alloying element selected from the group consisting of:

nickel, chromium, copper, manganese and molybdenum; and 0.3 to 0.75 wt % lubricant.

19. The article of claim 14, wherein said surface densified layer has a density of at least 97% of the full theoretical density of iron.

20. A sintered steel article formed from an iron-based powder containing at least 0.4 wt % C, comprising;

a) a core density between 6.8 and 7.6 g/cc;

b) a surface density greater than that of said core density to a depth of 0.1-2.0 mm and establishing a density gradient between the surface and the core; and c) a martensitic microstructure throughout the article.

21. The article of claim 20, wherein said iron-based powder comprises at least 0.5 wt % carbon.

22. The article of claim 20, wherein said article comprises a densified surface having a hardness of 55-65 HRC.

23. The article of claim 20, wherein the iron-based powder further comprises:

0.4 to 0.9 wt % graphite;

0.5 to 5 wt % of at least one alloying element selected from the group consisting of:

nickel, chromium, copper, manganese and molybdenum; and 0.3 to 0.75 wt % lubricant.

24. The article of claim 20 wherein said surface densified layer has a density of at least 97% of the full theoretical density of iron.

* * * * *